US006695640B2

(12) United States Patent
Uchibori et al.

(10) Patent No.: US 6,695,640 B2
(45) Date of Patent: Feb. 24, 2004

(54) ULTRASONIC DIAGNOSTIC EQUIPMENT

(75) Inventors: Masami Uchibori, Tokyo (JP); Sotaro Kawae, Tokyo (JP); Mitsuhiro Nozaki, Tokyo (JP)

(73) Assignee: GE Medical Systems Global Technology Company, LLC, Waukesha, WI (US)

( * ) Notice: Subject to any disclaimer, the term of this patent is extended or adjusted under 35 U.S.C. 154(b) by 0 days.

(21) Appl. No.: 10/116,477

(22) Filed: Apr. 4, 2002

(65) Prior Publication Data

US 2002/0146927 A1 Oct. 10, 2002

(30) Foreign Application Priority Data

Apr. 5, 2001 (JP) ..... 2001-106770

(51) Int. Cl.[7] ..... H01R 3/00
(52) U.S. Cl. ..... 439/490; 439/953; 439/911
(58) Field of Search ..... 439/489, 480, 439/911, 188, 159, 157, 953, 490; 200/51.09, 243

(56) References Cited

U.S. PATENT DOCUMENTS 3,960,428 A * 6/1976 Naus et al. ..... 439/315
5,479,930 A 1/1996 Gruner et al.
5,542,425 A * 8/1996 Marshall et al. ..... 600/437
5,607,435 A 3/1997 Sachdeva et al.
5,635,619 A 6/1997 Udpa et al.
5,762,067 A 6/1998 Dunham et al.
6,048,020 A 4/2000 Gronowicz et al.
6,309,358 B1 10/2001 Okubo
6,325,760 B1 12/2001 Takanori et al.
6,375,619 B1 * 4/2002 Ohdachi ..... 600/459

FOREIGN PATENT DOCUMENTS

EP 0011 413 * 5/1980

* cited by examiner

*Primary Examiner*—Phuong K. Dinh
(74) *Attorney, Agent, or Firm*—Carl B. Horton, Esq.; Armstrong Teasdale LLP

(57) ABSTRACT

In order for an operator to perceive a lock completion of the mechanical connection between a connector of an ultrasonic probe and a socket of an ultrasonic diagnostic equipment main body, the following structure is provided. In the ultrasonic diagnostic equipment, the ultrasonic probe includes a connector portion having a lock mechanism (a cam shaft penetrating a connector, a conductive movable contact/lock pin projecting from the cam shaft, and a connector lock releasing handle), and an ultrasonic probe main body. The ultrasonic diagnostic equipment main body includes a socket having connection hole H for connecting the connector, a locking confirming contact points for conducting by being in contact with the movable contact/lock pin as the connection with the connector being mechanically locked, LED for illuminating under conduction, and a safety circuit for allowing for starting scanning when conducting.

4 Claims, 6 Drawing Sheets

ULTRASONIC DIAGNOSTIC EQUIPMENT

CROSS REFERENCE TO RELATED APPLICATIONS

This application claims the benefit of Japanese Application No. 2001–106770 filed Apr. 5, 2001.

BACKGROUND OF THE INVENTION

The present invention relates to ultrasonic diagnostic equipment, and in particular, relates to ultrasonic diagnostic equipment in which completion of a mechanical connection of a connector of an ultrasonic probe and a socket of an ultrasonic diagnostic equipment main body can be perceived by an operator.

FIG. 1 is a perspective view illustrating a connector portion of an ultrasonic probe of an example of conventional ultrasonic diagnostic equipment.

The connector portion 301 of the ultrasonic probe includes a connector 12 having signal terminals 11 aligned therein, and a lock mechanism 30 that includes a lock pin 31, a cam shaft 13, and a connector lock releasing handle 14, for mechanically locking the connector 12 by connection with a socket of an ultrasonic diagnostic equipment main body (not shown).

When connecting the ultrasonic probe with the ultrasonic diagnostic equipment main body, an operator first inserts the connector 12 into the socket of the ultrasonic diagnostic equipment main body, and then turns the connector lock releasing handle 14, whereby connection between the connector 12 and the socket gets locked. When electrical connection of both parts is confirmed, ultrasonic scanning is performed.

When detaching the ultrasonic probe from the ultrasonic diagnostic equipment main body, the operator turns the connector lock-releasing handle 14 in an opposite direction from the direction for connecting them, thereby, the connection is released. Thereafter, the connector 12 is pulled out from the socket.

In the above-described conventional connector portion 301 of the ultrasonic probe, the connection between the connector 12 and the socket of the ultrasonic diagnostic equipment main body are checked electrically.

However, during the checking process as described above, even if the mechanical lock between the connector 12 and the socket are not completed, i.e., when signal terminals are unstably in contact with each other, it was still perceived as the completion of the connection, and the scanning process may start under such a condition.

SUMMARY OF THE INVENTION

In view of the above, an object of the present invention is to provide ultrasonic diagnostic equipment in which an operator thereof can perceive the completion of the mechanical connection between a connector of an ultrasonic probe and a socket of an ultrasonic diagnostic equipment main body.

In the first aspect of the present invention, there is provided ultrasonic diagnostic equipment provided with a lock perceiving means for letting an operator perceive that connection between a connector of an ultrasonic probe and a socket of an ultrasonic diagnostic equipment main body being mechanically locked.

According to the ultrasonic diagnostic equipment of the first aspect, it is possible for an operator to perceive that the connection between the connector of the ultrasonic probe and the socket of the ultrasonic diagnostic equipment main body are mechanically locked, thus enabling to prevent scanning from starting before completion of the locking.

In the second aspect of the present invention, there is provided ultrasonic diagnostic equipment with the above-described structure, in which the lock perceiving means includes a lock confirming conduction means for changing electric conduction as the connection between the connector of the ultrasonic probe and the socket of the ultrasonic diagnostic equipment main body being mechanically locked, and a lock informing means for informing the operator of the locking based on a change of the electrical conduction.

According to the ultrasonic diagnostic equipment of the second aspect, by changing conduction depending on whether or not the connection between the connector of the ultrasonic probe and the socket of the ultrasonic diagnostic equipment main body is mechanically locked, the lock completion can be detected, and may be informed it to the operator.

In the third aspect of the present invention, there is provided ultrasonic diagnostic equipment having the above-described structure, in which the lock confirming conduction means includes a conductive movable contact/lock pin projecting in a direction perpendicular to a cam shaft provided to the connector and having a connector lock releasing handle attached thereto, and lock confirming contact points, provided to the ultrasonic diagnostic equipment main body, that brings points into conduction by coming in contact with the movable contact/lock pin as the connection locks.

According to the ultrasonic diagnostic equipment of the third aspect, as the connection is being locked, the movable contact/lock pin changes a angle thereof as the connector lock releasing handle for operation moves, and comes into contact with the lock confirming contact points so as to bring the contact points into conduction. On the other hand, when the connection is not locked, the movable contact/lock pin is not in contact with the lock confirming contact points, and thus, the contact points are not conducting.

As a result, it is possible to differ the conduction condition when it is locked and not locked, thus enabling to implement the ultrasonic diagnostic equipment according to the second aspect preferably.

In the fourth aspect of the present invention, there is provided ultrasonic diagnostic equipment with the above-described structure, in which, the lock confirming conduction means has a flange conductor provided to the connector and having a movable contact/hook-shaped lock pin projected from a tip of a cam shaft, and a lock confirming conductor, provided to the ultrasonic diagnostic equipment main body, that brings conductors into conduction as the flange conductor and the movable contact/hook-shaped lock pin coming into contact with each other as the connection locks.

According to the ultrasonic diagnostic equipment of the fourth aspect, as the connection is locked, the movable contact/hook-shaped lock pin, i.e., the lock pin bent into hook shape, that changes its angle as the connector lock releasing handle for operation moves, connects with one of the lock confirming conductor, while the flange connector comes into contact with the other lock confirming conductor, so that the conductors become conducting. Whereas, when the connection is not locked, the movable contact/hook-shaped lock pin is not in contact with the lock-confirming conductor, thus the conductors are not conducting.

As a result, it is possible to differ conduction condition when it is locked or not locked, thus enabling to implement the ultrasonic diagnostic equipment according to the second aspect preferably. Moreover, comparing to the movable contact/lock pin projecting linearly, it is possible to reduce the occupation area, thus desirable for downsizing.

In the fifth aspect of the present invention, there is provided ultrasonic diagnostic equipment with the above-described structure, in which the lock informing means is a light-emitting means provided to the ultrasonic diagnostic equipment main body.

According to the ultrasonic diagnostic equipment of the fifth aspect, the light-emitting means of the ultrasonic diagnostic equipment main body illuminates as the connection is locked, thus enabling for the operator to perceive the completion of locking.

In the sixth aspect of the present invention, there is provided ultrasonic diagnostic equipment with the above-described structure, in which the lock informing means is a light-emitting means provided to the ultrasonic probe.

According to the ultrasonic diagnostic equipment of the sixth aspect, the light-emitting means of the ultrasonic diagnostic equipment main body illuminates as the connection is locked, thus enabling for the operator to perceive the completion of locking. Moreover, the operator can perceive the lock completion by just looking at the ultrasonic probe at hand, thus enabling to improve the visibility.

In the seventh aspect of the present invention, there is provided ultrasonic diagnostic equipment according with the above-described structure, in which the ultrasonic diagnostic equipment includes a safety circuit that allows ultrasonic scanning only when it is conducting as it locks.

According to the ultrasonic diagnostic equipment of the seventh aspect, the safety circuit allows ultrasonic scanning only under the conduction while the connection is being locked, thus preventing scanning from starting under incomplete locking thereby improving the safety.

In the eighth aspect of the present invention, there is provided ultrasonic diagnostic equipment with the above-described structure, in which the lock perceiving means is an operation feel adding means for giving a tactile feeling to the operator by a lock mechanism of the connector and the locking member of the socket fitting into each other as the connection between the connector of the ultrasonic probe and the socket of the ultrasonic diagnostic equipment main body is mechanically locked.

According to the ultrasonic diagnostic equipment of the eighth aspect, the locking mechanism of the connector of the ultrasonic probe fits into the locking member of the socket of the ultrasonic diagnostic equipment main body so as to give a tactile feeling to the operator, and thus, the operator can perceive the lock completion with a simple and inexpensive mechanism without an electronics circuit or the like.

In the ninth aspect of the present invention, there is provided ultrasonic diagnostic equipment with the above-described structure, in which the operation feel adding means includes a lock pin provided to the connector and projecting from a cam shaft having a connector lock releasing handle attached thereto, and a locking member provided to the ultrasonic diagnostic equipment main body and having a groove engraved thereto for fitting the lock pin as the connection locks.

According to the ultrasonic diagnostic equipment of the ninth aspect, the lock pin projecting form the cam shaft of the connector of the ultrasonic probe is fitted into the locking member of the ultrasonic diagnostic equipment main body as the connection is locked so as to give a tactile feeling to the operator. Thus, the conventional ultrasonic probe can be used. Moreover, engraving a groove to the locking member can be inexpensive, thus desirable to reduce the cost.

In the tenth aspect of the present invention, there is provided ultrasonic diagnostic equipment with the above-described structure, in which the lock perceiving means is a push-locking completion sound generation means for generating sound indicating completion of push-lock due to striking of the lock mechanism of the connector to the locking member of the socket as the connector of the ultrasonic probe being pushed into the socket of the ultrasonic diagnostic equipment main body to lock the connection mechanically.

According to the ultrasonic diagnostic equipment of the tenth aspect, as the connector of the ultrasonic probe is pushed into the socket of the ultrasonic diagnostic equipment main body so as to be locked therewith, thus sound indicating the lock completion is generated, and thus, the operator can perceive the lock completion.

In the 11th aspect of the present invention, there is provided ultrasonic diagnostic equipment with the above-described structure, in which the push-locking completion sound generation means includes a locking shaft with a hook provided on a tip thereof that moves with the push locking button provided to the connector, and a hook engaging member for engaging the hook provided to the ultrasonic diagnostic equipment main body as the connection locks.

According to the ultrasonic diagnostic equipment of the 11th aspect, the operator can securely connect the connector of the ultrasonic probe and the socket of the ultrasonic diagnostic equipment main body by a single operation, i.e., by pressing down the push lock button, thus enabling to securely lock the connection.

In the 12th aspect of the present invention, there is provided ultrasonic diagnostic equipment with the above-described structure, in which the ultrasonic diagnostic equipment includes a engaging release means for detaching the hook engaged by the hook engaging member when releasing the connector, and an elastic means for returning the push-locking button and the locking shaft with a hook to an original position with elasticity as the engagement is released.

According to the ultrasonic diagnostic equipment of the 12th aspect, the connector and the socket can be detached by simply detaching the hook of the locking shaft from the hook engaging member because the elasticity of the spring returns the push lock button and the locking shaft with a hook in their original position.

In the 13th aspect of the present invention, there is provided ultrasonic diagnostic equipment with the above-described structure, in which the lock perceiving means displays lock confirming information on a screen of a display device of the ultrasonic diagnostic equipment main body as the connection is locked.

According to the ultrasonic diagnostic equipment of the 13th aspect, by displaying the lock confirming information, i.e., a lock confirming mark or a message indicating the lock completion, on the screen of the display device as the connection is locked, the operator can perceive the lock completion, whereby it is unnecessary to provide a light-emitting means to inform the lock completion, thus enabling to form the ultrasonic diagnostic equipment in the same appearance as the conventional one.

In the 14th aspect of the present invention, there is provided ultrasonic diagnostic equipment with the above-described structure, in which the lock perceiving means outputs sound for informing as the connection is locked.

According to the ultrasonic diagnostic equipment of the 14th aspect, by outputting the sound for informing the lock completion, i.e., beep or the lock confirming message, the operator can perceive the lock completion. Thus, the operator can perceive the lock completion aurally.

In the 15th aspect of the present invention, there is provided ultrasonic diagnostic equipment with the above-described structure, in which the lock perceiving means detects with a contact type sensor that the connection between the connector of the ultrasonic probe and the socket of the ultrasonic diagnostic equipment main body is mechanically locked.

According to the ultrasonic diagnostic equipment of the 15th aspect, by adding the contact-type sensor that comes in contact with the lock pin as the connection is locked, the lock completion can be detected. Therefore, the conventional locking mechanism of the connector or the locking member of the socket may be used as they are or by partially modifying them. Moreover, universal contact-type sensor can be used, thus being advantageous in terms of the cost reduction.

In the 16th aspect of the present invention, there is provided ultrasonic diagnostic equipment with the above-described structure, in which the lock perceiving means detects with a non-contact type sensor that the connection between the connector of the ultrasonic probe and the socket of the ultrasonic diagnostic equipment main body is mechanically locked.

According to the ultrasonic diagnostic equipment of the 16th aspect, by adding a non-contact type sensor, such as a photo interrupter, which is attached to a position where a state of through-light or reflecting-light changes by the lock pin as the connection is locked, it is possible to detect the lock completion. Therefore, the conventional locking mechanism of the connector or the locking member of the socket may be used as they are or by partially modifying them. Moreover, by the non-contact detection, it is possible to prevent the mechanisms from wearing.

According to the ultrasonic diagnostic equipment of the present invention, it is possible to prevent scanning from starting when connection between a connector and a socket is not completed. Moreover, when there is no feedback to let an operator know of the lock completion, the operator can re-connect them by re-inserting the connector or re-operating the handle, thus enabling to perform connecting operation securely.

Further objects and advantages of the present invention will be apparent from the following description of the preferred embodiments of the invention as illustrated in the accompanying drawings.

DETAILED DESCRIPTION OF THE INVENTION

Hereinbelow, preferred embodiments of the present invention will be described with reference to drawings. The embodiments are not to limit the present invention thereto.

Embodiment 1

Figure 1:
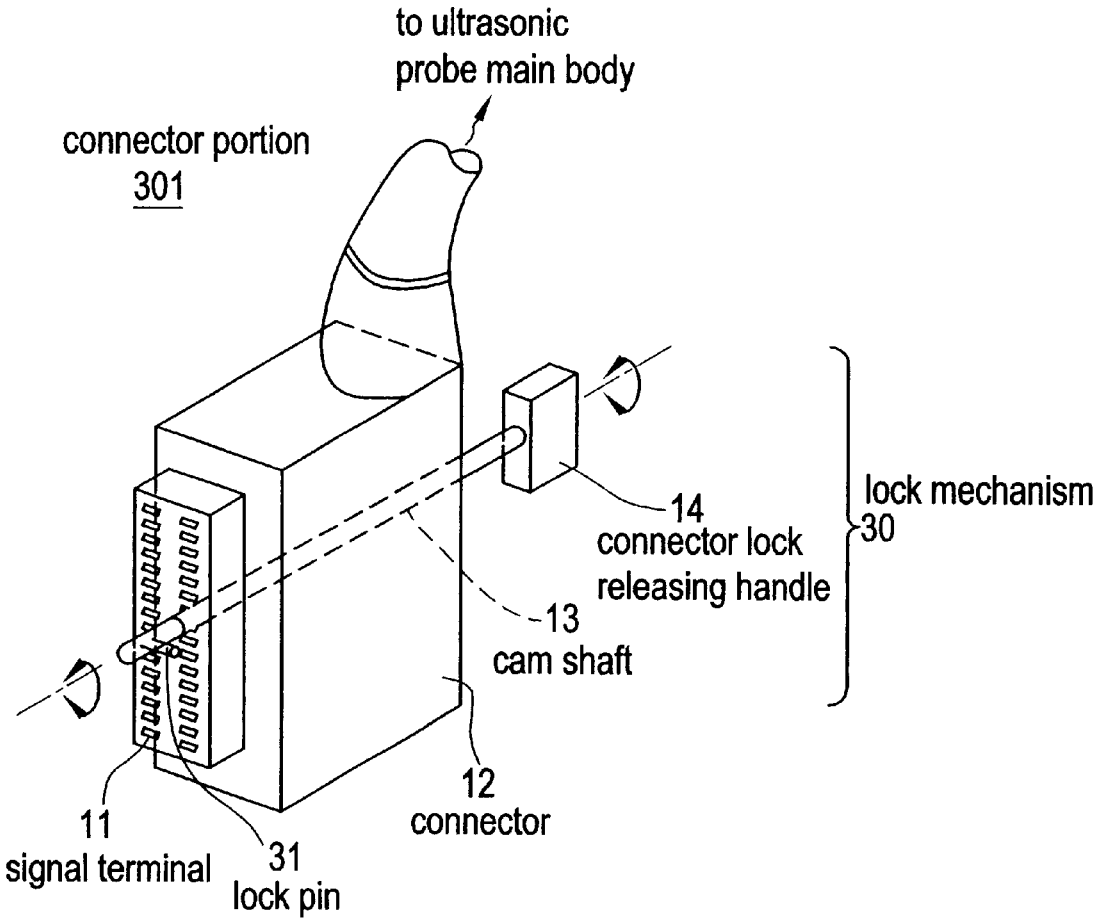
FIG. 1 is a perspective view showing a connector portion of an ultrasonic probe according to one example of a conventional ultrasonic diagnostic equipment.
Figure 2:
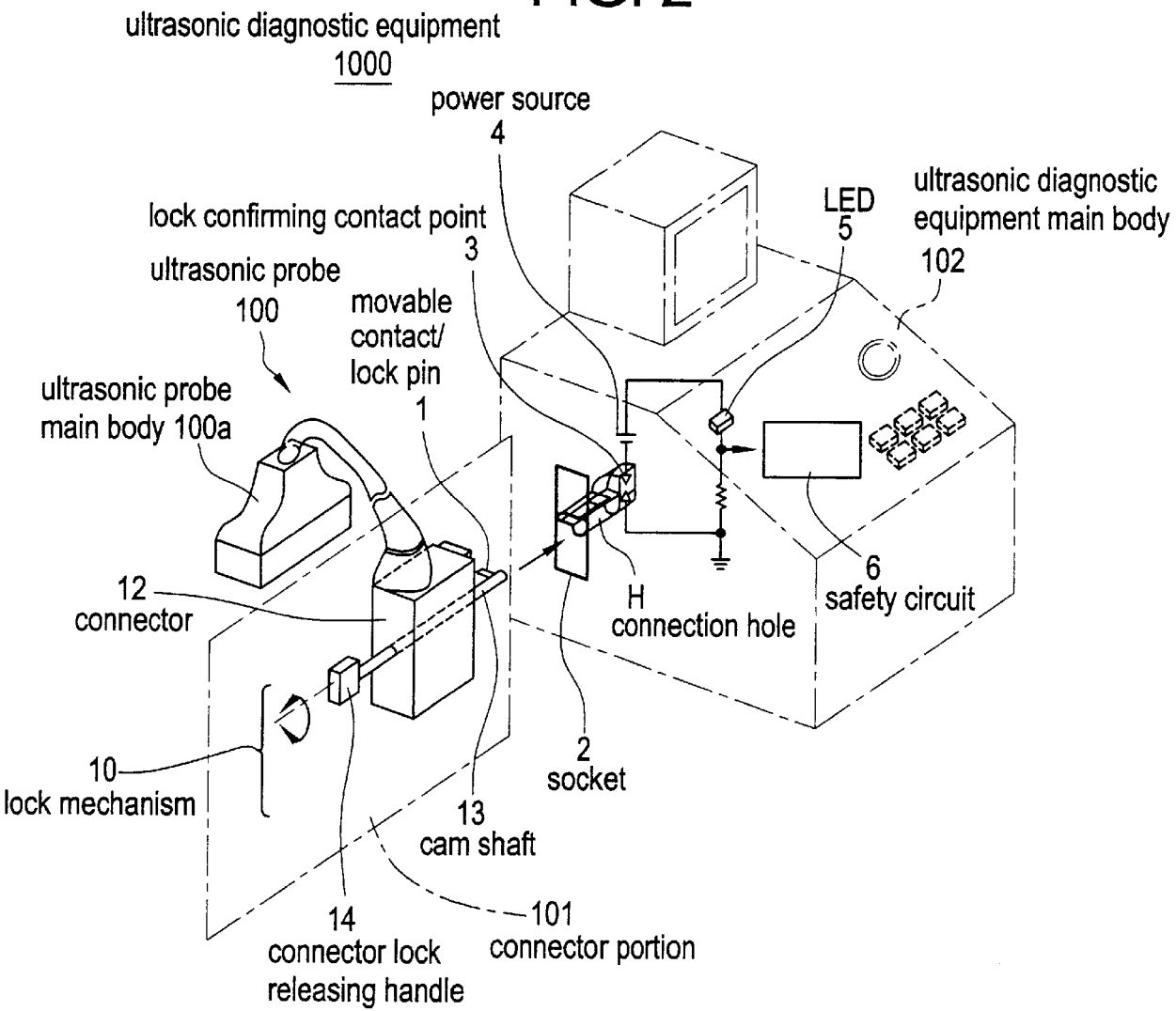
FIG. 2 is a block diagram showing ultrasonic diagnostic equipment according to Embodiment 1.

FIG. 2 is a block diagram showing an ultrasonic diagnostic equipment according to Embodiment 1 of the present invention.

Ultrasonic diagnostic equipment 1000 is provided with an ultrasonic probe 100 for transmitting ultrasonic to a test subject as well as receiving an ultrasonic echo from the test subject, and an ultrasonic diagnostic equipment main body 102 having an operation button, a track ball, a Cathode Ray Tube (hereinafter referred to as CRT) device and the like.

The ultrasonic probe 100 includes a connector portion 101 having connector 12 with signal terminal 11 aligned therein and a mechanism 10, ultrasonic probe main body 100*a* having many built-in ultrasonic transducer (not shown). The mechanism 10 includes a cam shaft 13 penetrating through the connector 12, a conductive movable contact/lock pin 1 projecting perpendicularly from a tip of the cam shaft 13, and a connector lock releasing handle 14 attached to an end of the cam shaft 13.

The ultrasonic diagnostic equipment main body 102 includes a socket 2 with a connecting hole H, a lock confirming contact point 3 for confirming that the connection is mechanically locked, power source 4, Light Emitting Diode (hereinafter referred to as LED) 5 for letting an operator know about completion of locking, and a safety circuit 6 enabling to start ultrasonic scanning only when the locking is confirmed.

Figure 3:
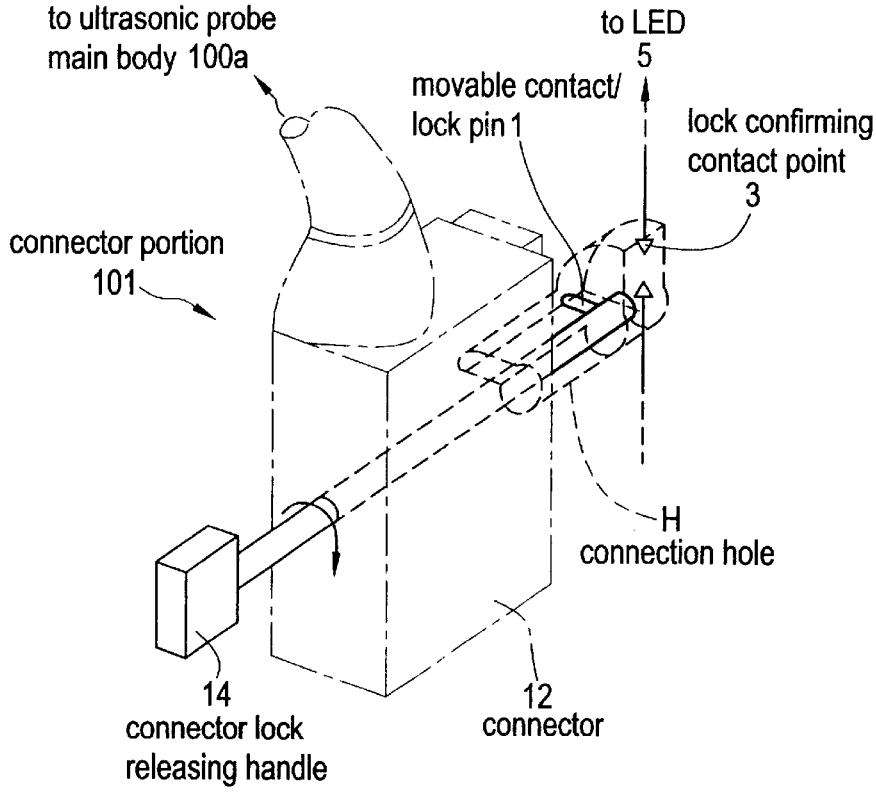
FIG. 3 is a diagram illustrating a state where a connector of an ultrasonic probe is inserted into a socket of an ultrasonic diagnostic equipment main body in the ultrasonic diagnostic equipment shown in FIG. 2.

When the ultrasonic probe 100 connects with the ultrasonic diagnostic equipment main body 102, an operator inserts a signal terminal side of the connector 12 into the connecting hole H of a socket 2 of the ultrasonic diagnostic equipment main body 102. Immediately after the insertion, the movable contact/lock pin 1 is not in contact with the lock confirming contact point 3, as shown in FIG. 3, thus contact points are out of conduction, thus not illuminating the LED 5. After insertion, the operator turns the connector lock releasing handle 14.

Figure 4:
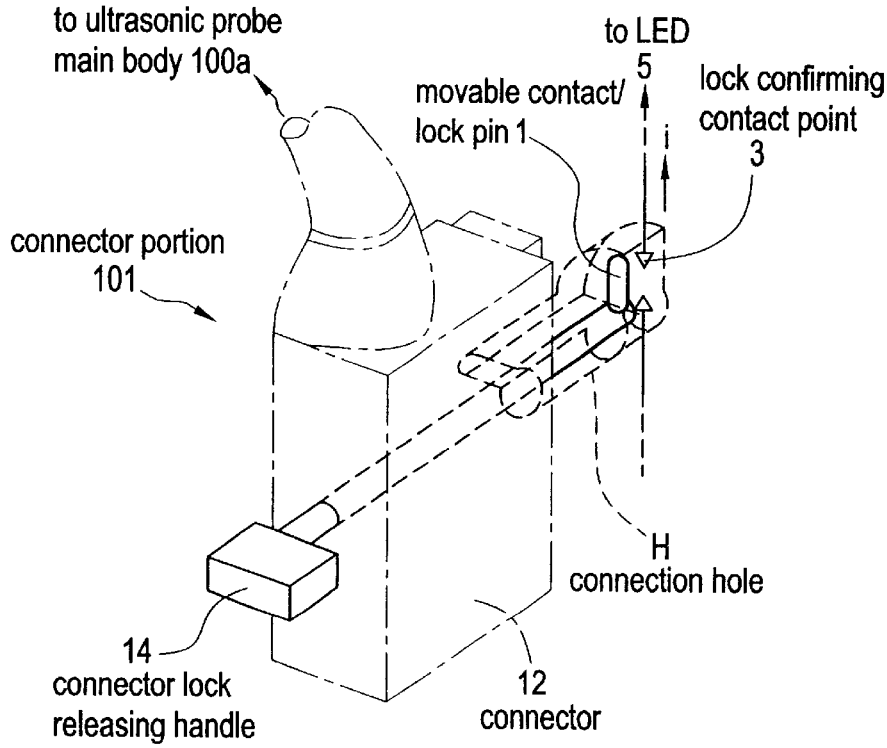
FIG. 4 is a diagram illustrating a state where the connection between the connector of the ultrasonic probe and the socket of the ultrasonic diagnostic equipment main body is mechanically locked in the ultrasonic diagnostic equipment shown in FIG. 1.

As shown in FIG. 4, when the connection between the connector 12 and the socket 2 is mechanically locked, the movable contact/lock pin 1 becomes in contact with the lock confirming contact point 3, thus conducting therebetween. Thus, a lock confirming current i is flown thereinto so as to illuminate the LED 5. As a result, the operator can perceive the locking has been completed. Moreover, when the safety circuit 6 detects the lock confirming current i, it enables to start scanning (unless such current is detected, the safety circuit 6 prohibits scanning). Thus, it is possible to prevent scanning from starting when locking is incomplete.

When detaching the ultrasonic probe 100 from the ultrasonic diagnostic equipment main body 102 the operator turns the connector lock releasing handle 14 in a direction opposite from the direction for connecting them, thereby the connection is released. Thereafter, the connector 12 is pulled out from the socket 2.

According to the ultrasonic diagnostic equipment 1000 according to Embodiment 1, the LED 5 illuminates only when connection between the connector 12 of the ultrasonic terminal 100 and the socket 2 of the ultrasonic diagnostic equipment main body 102 are mechanically locked, whereby the operator can perceive completion of locking. Moreover, the safety circuit 6 prevents scanning from beginning under incomplete locking, thus enabling to improve safety thereof.

Embodiment 2

Figure 5:
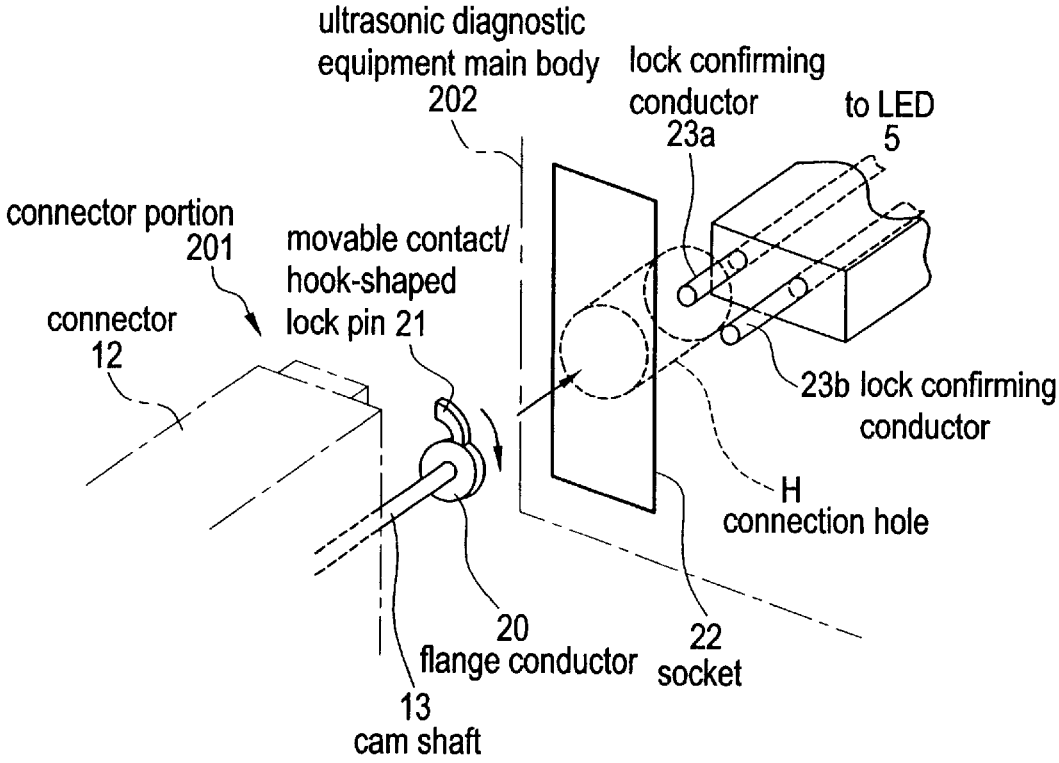
FIG. 5 is a diagram illustrating a connector portion of an ultrasonic probe and a socket portion of an ultrasonic diagnostic equipment main body of ultrasonic diagnostic equipment according to Embodiment 2.

FIG. 5 is a diagram illustrating showing a connector portion 201 of an ultrasonic probe of an ultrasonic equipment according to Embodiment 2 of the present invention and a socket portion of an ultrasonic diagnostic equipment main body 202 thereof. Embodiment 2 is similar to the ultrasonic diagnostic equipment 1000 according to Embodiment 1 in a manner that the connector portion 201 includes the connector lock releasing handle 14 and the ultrasonic diagnostic equipment main body 202 includes the power source 4 and the LED 5.

In the connector portion 201, a flange conductor 20 having a movable contact/hook-shaped, lock pin 21 provided so as to project therefrom is provided on a tip of a cam shaft 13.

In a deep recess of a connecting hole H of the socket 22 of the ultrasonic diagnostic equipment main body 202 has lock confirming conductors 23*a* and 23*b* provided so as to project therefrom.

When the connector 12 connects with the socket 22, a signal terminal side of the connector 12 is inserted into the connecting hole H of the socket 22. Immediately after the insertion, the movable contact/hook-shaped lock pin 21 does not come in contact with the lock confirming conductors 23*a* and 23*b*, and thus, among conductors are out of conduction, thereby not illuminating the LED 5. After the insertion, the operator turns the connector lock releasing handle 14.

Figure 6:
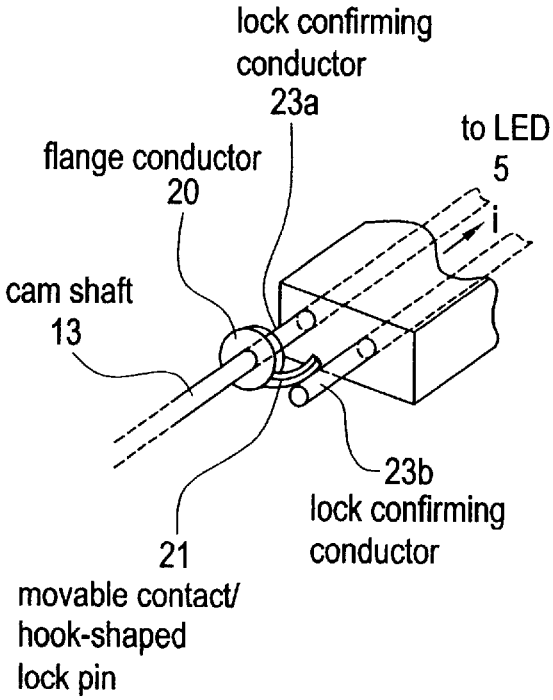
FIG. 6 is a diagram illustrating a state where a connector of an ultrasonic probe is inserted into a socket of ultrasonic diagnostic equipment main body in the ultrasonic diagnostic equipment shown in FIG. 5.

As shown in FIG. 6, when the connection between the connector 12 and the socket 22 is mechanically locked, the movable contact/hook-shaped lock pin 21 becomes in contact with the lock confirming conductors 23*a* and 23*b*, thus conducting therebetween. Thus, a lock confirming current i is flown thereinto so as to illuminate the LED 5. As a result, the operator can perceive the locking has been completed.

As such, according to the ultrasonic diagnostic equipment according to Embodiment 2, completion of locking is detected by using the lock pin 21 bent in hook-shape. Thus, comparing to the movable contact/lock pin 1 (see FIGS. 2 to 4) projecting linearly from the cam shaft 13, an occupation area thereof can be reduced in the case of the hook-shaped lock pin 21, therefore, desirable for downsizing.

Embodiment 3

Figure 7:
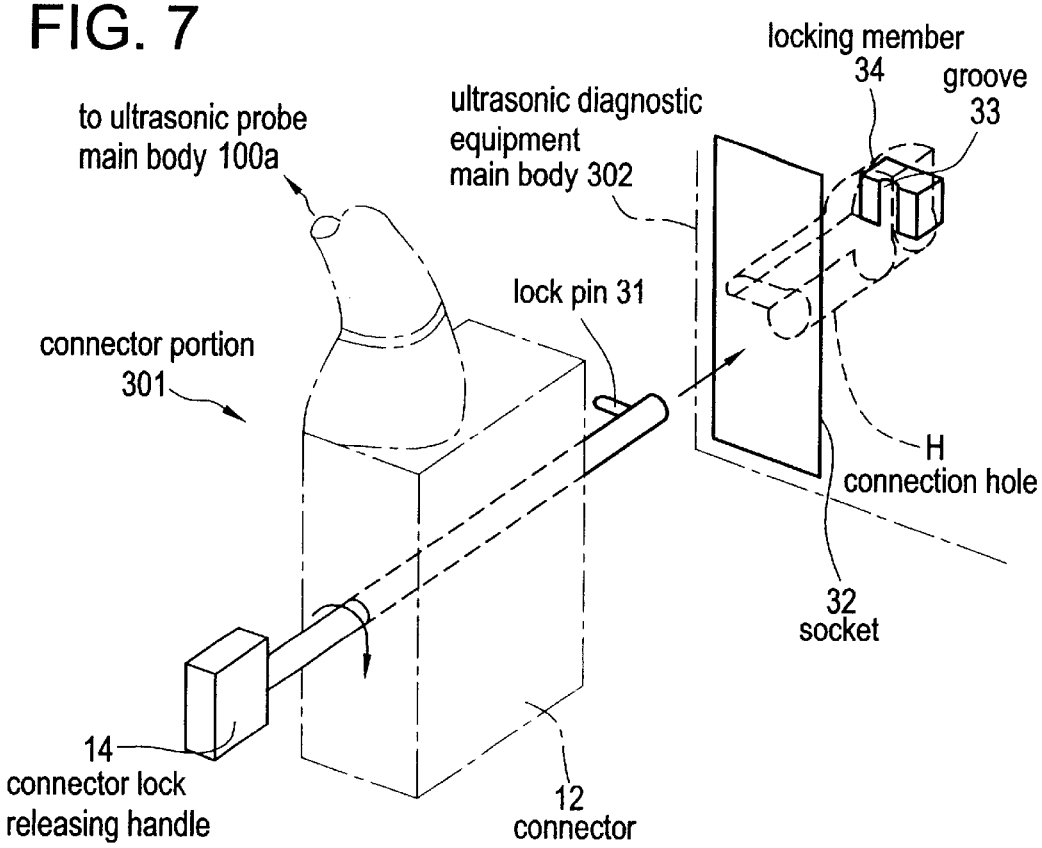
FIG. 7 is a diagram illustrating a state where a connector of an ultrasonic probe is inserted into a socket of an ultrasonic diagnostic equipment main body in the ultrasonic diagnostic equipment according to Embodiment 3.

FIG. 7 is a diagram illustrating showing a connector portion 301 of an ultrasonic probe of an ultrasonic equipment according to Embodiment 3 of the present invention and a socket portion of an ultrasonic diagnostic equipment main body 302 thereof.

The connector portion 301 is the same as the connector portion of a conventional ultrasonic diagnostic equipment. Specifically, the connector portion 301 includes a connector 12, a cam shaft 13, a lock pin 31 and a connector lock releasing handle 14. In a deep recess of a connecting hole H of the socket 32 of the ultrasonic diagnostic equipment main body 302, a locking member 34 is provided with a groove 33 engraved for fitting a lock pin 31 of the connector portion 301 in use for a time of locking.

When the ultrasonic probe connects with the ultrasonic diagnostic equipment main body 302, as shown in FIG. 7, an operator inserts a signal terminal side of the connector 12 to a connection hole H of the socket 32 of the ultrasonic diagnostic equipment main body 302. Immediately after the insertion, the lock pin 31 is not fitted into the groove 33. After the insertion, the operator turns the connector lock releasing handle 14.

Figure 8:
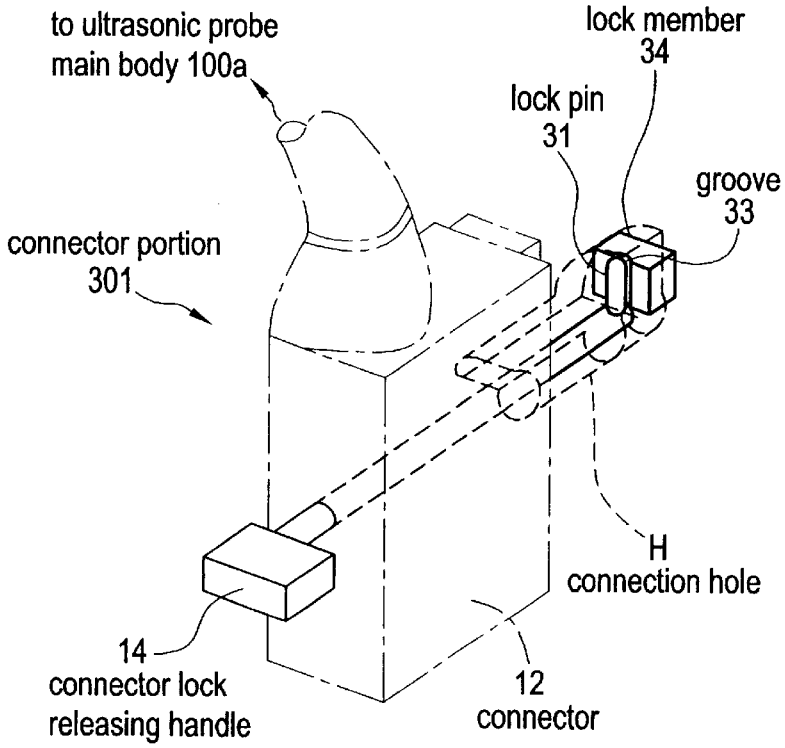
FIG. 8 is a diagram illustrating a state where the connection between the connector of the ultrasonic probe and the socket of the ultrasonic diagnostic equipment main body is mechanically locked in the ultrasonic diagnostic equipment shown in FIG. 7.

As shown in FIG. 8, in the instant when the connection between the connector 12 and the socket 32 are locked mechanically, the lock pint 31 fits into the groove 33 of the locking member 34, so as to give tactile feeling to the operator who touches the connector lock releasing handle 14. As a result, the operator can perceive the completion of locking.

When detaching the ultrasonic probe from the ultrasonic diagnostic equipment main body 302, the operator turns the connector lock releasing handle 14 in an opposite direction from the direction for connecting them. Thereafter, the connector 12 is pulled out from the socket 2.

According to the ultrasonic diagnostic equipment according to Embodiment 3, when the connection between the connector 12 of the ultrasonic probe and the socket 32 of the ultrasonic diagnostic equipment main body 302 is mechanically locked, the operator can get a tactile feeling, thereby the operator can perceive the completion of locking.

Embodiment 4

Figure 9:
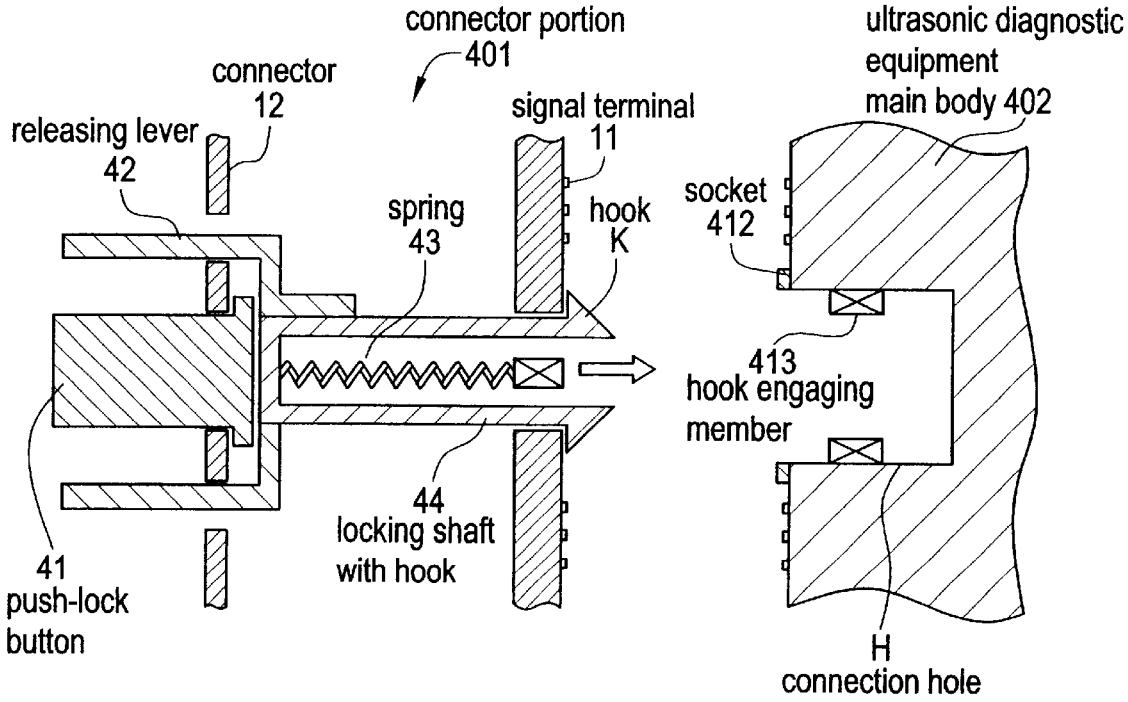
FIG. 9 is an end-surface diagram illustrating a connector portion of an ultrasonic probe and a socket portion of an ultrasonic diagnostic equipment main body of ultrasonic diagnostic equipment according to Embodiment 4.

FIG. 9 is an end-surface view showing a connector portion 401 of an ultrasonic probe of ultrasonic diagnostic equipment and a socket portion of an ultrasonic diagnostic equipment main body 402 according to Embodiment 4 of the present invention.

The connector portion 401 includes a connector 12 having signal terminals 11 aligned therein, a push lock button 41 for push-locking the connector 12, a release lever 42 for releasing the lock, a locking shaft with a hook 44 having a hook K on a tip thereof, and a spring 43.

The ultrasonic diagnostic equipment main body 402 is provided with a socket 412 having a connecting hole H, and a hook engaging member 413 for engaging the hook K of the locking shaft with a hook 44 at a time of push-locking.

When connecting the connector to the socket 412, the operator presses down the push-locking button 41.

Figure 10:
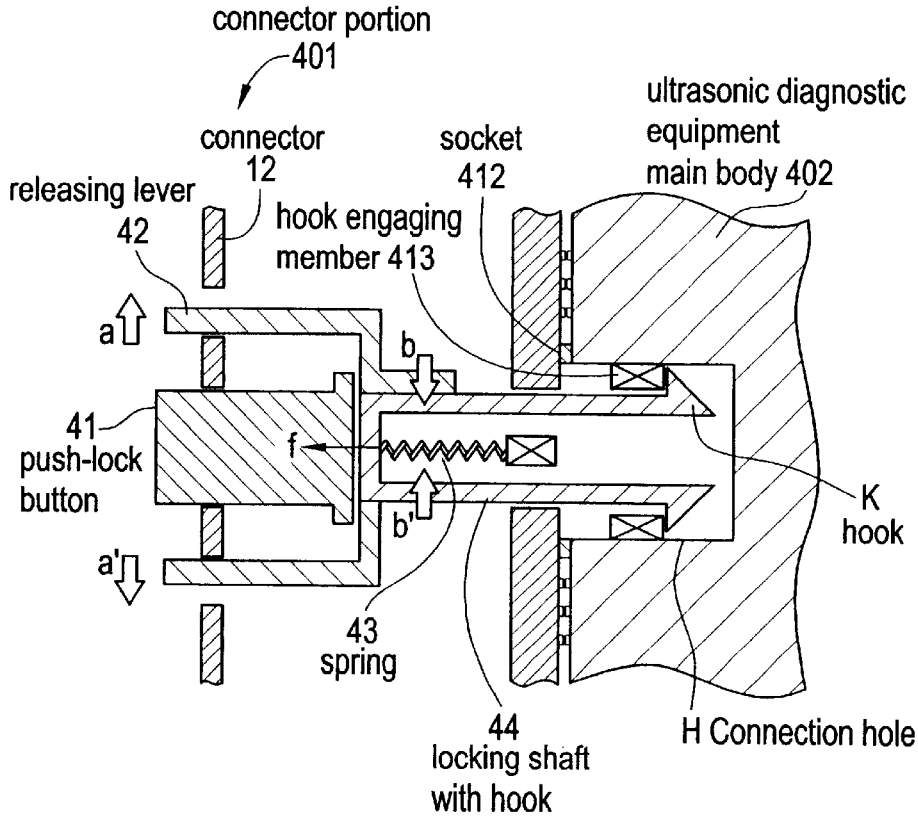
FIG. 10 is an end-surface diagram illustrating a state where the connection between the connector of the ultrasonic probe and the socket of the ultrasonic diagnostic equipment main body is mechanically locked in the ultrasonic diagnostic equipment shown in FIG. 9.

Then, as shown in FIG. 10, the hook K of the locking shaft 44 is engaged over the hook engaging member 413 so that the connection between the connector 12 and the socket 412 is mechanically locked. At the instant of the engagement, the hook K of the locking shaft 44 and the hook engaging member 413 strike each other so as to generate a sound indicating the completion of push-locking (e.g., a short clicking sound). As a result, the operator can perceive the completion of locking.

When detaching the connector 12 from the socket 412, the operator presses open the release lever 42 along arrows a, a'. Thus, the locking shaft with a hook 44 is narrowed in a direction along arrows b, b' so that the hook K come off from the hook engaging member 413 so as to release the connection. Specifically, the locking shaft with a hook 44 and the push-locking button 41 and the release lever 42 return to a position shown in FIG. 9 by a elasticity f of the spring 43.

According to the ultrasonic diagnostic equipment according to Embodiment 4, the connection between the connector 12 of the ultrasonic probe and the socket 412 of the ultrasonic diagnostic equipment main body 402 can be locked by single operation, i.e., pressing down the push-locking button 41. Moreover, with the sound indicating the completion of the push-locking, the operator can perceive the completion of locking. Furthermore, by press-opening the release lever 42, the connector 12 can be released easily.

Other Embodiments (1) The ultrasonic diagnostic equipment 1000 according to Embodiment 1 as described above, the LED 5 is provided only for the ultrasonic diagnostic equipment main body 102. Alternatively, instead of or in addition to the ultrasonic diagnostic equipment may body 102, the LED 5 may be provided to the ultrasonic probe 100 (either the ultrasonic probe main body 100*a* or the connector portion 101). In this case, the operator can perceive the completion of locking by just looking at the ultrasonic probe 100 on hand, thus enabling to improve visibility.

(2) Instead of or in addition to illuminating the LED 5, lock confirming information (such as a lock confirming mark of any sort or a message saying "lock completion confirmed") may be displayed on a screen of the CRT device of the ultrasonic diagnostic equipment main body 102. In this case, there is no need for providing the LED 5, and thus, the ultrasonic diagnostic equipment may be formed in the same appearance as the conventional equipment.

(3) Instead of or in addition to illumination the LED 5, an electrical sound (such as a beeping sound or a message saying "the lock completion confirmed") may be produced from the ultrasonic diagnostic equipment 1000 or the ultrasonic probe 100 when the lock confirming contact points are conducting. In this case, the operator can perceive the lock completion by the auditory sense instead of watching the LED 5 or the like.

(4) At a time of locking, the lock completion may be detected by using a contact-type sensor such as a contact switch, which changed the contact position as being in contact with the lock pin 31 (see FIGS. 7 and 8) for example. Moreover, when locking, for example, the P lock completion may be detected by using non-contact-type sensor such as a photo interrupter attached to a position where a state of through-light or reflecting-light changes by the lock pin 31. When using such sensor, the lock pin (FIG. 3 to 4–1, and FIGS. 5 to 6 (21)) does not have to be conductive. Moreover, there is no need to provide the locking member of the ultrasonic diagnostic equipment main body.

Many widely different embodiments of the invention may be configured without departing from the spirit and the scope of the present invention. It should be understood that the present invention is not limited to the specific embodiments described in the specification, except as defined in the appended claims.

What is claimed is:

1. Ultrasonic diagnostic equipment provided with a lock perceiving means for letting an operator perceive that connection between a connector of an ultrasonic probe and a socket of an ultrasonic diagnostic equipment main body being mechanically locked, the lock perceiving means includes a lock confirming conduction means for changing electric conduction as the connection between the connector of the ultrasonic probe and the socket of the ultrasonic diagnostic equipment main body being mechanically locked, and a lock informing means for informing the operator of the locking based on a change of the electrical conduction, the lock confirming conduction means includes a conductive movable contact/lock pin projecting in a direction perpendicular to a cam shaft provided to the connector and having a connector lock releasing handle attached thereto, and lock confirming contact points, provided to the ultrasonic diagnostic equipment main body, that brings points into conduction by coming in contact with the movable contact/lock pin when locking.

2. Ultrasonic diagnostic equipment according to claim 1, wherein the lock informing means is a light-emitting means provided to the ultrasonic diagnostic equipment main body.

3. Ultrasonic diagnostic equipment according to claim 1, wherein the ultrasonic diagnostic equipment includes a safety circuit that allows ultrasonic scanning only when it is conducting as it locks.

4. Ultrasonic diagnostic equipment according to claim 1, wherein the lock perceiving means detects with a contact type sensor that the connection between the connector of the ultrasonic probe and the socket of the ultrasonic diagnostic equipment main body is mechanically locked.

* * * * *